United States Patent [19]

Cayton

[11] 4,165,806

[45] Aug. 28, 1979

[54] PALLETIZING SYSTEM FOR PRODUCE CARTONS AND THE LIKE

[75] Inventor: David W. Cayton, Cupertino, Calif.

[73] Assignee: Bud Antle, Inc., Salinas, Calif.

[21] Appl. No.: 848,881

[22] Filed: Nov. 7, 1977

Related U.S. Application Data

[63] Continuation of Ser. No. 708,335, Jul. 26, 1976, abandoned.

[51] Int. Cl.[2] ..... B65D 19/22

[52] U.S. Cl. ..... 206/386; 108/53.1; 108/55.1

[58] Field of Search ..... 108/51.1, 51.3, 53.1–53.5, 108/55.1–57.1; 211/72; 214/10.5 R, 10.5 D, 10.5 S, 152; 217/43 A; 206/83, 386, 460, 597, 600; 403/292

[56] References Cited

U.S. PATENT DOCUMENTS

| | | | |
|---|---|---|---|
| 653,328 | 7/1900 | Tyden | 403/292 |
| 991,722 | 5/1911 | Hourd | 403/292 X |
| 2,489,054 | 11/1949 | Sprolle | 108/51.3 X |
| 2,534,011 | 12/1950 | Frye | 108/51.3 X |
| 2,658,614 | 11/1953 | Van Patten | 214/10.5 R X |
| 2,683,010 | 7/1954 | Hamerslag, Jr. | 108/53.5 |
| 2,686,646 | 8/1954 | McMillan | 108/55.1 |
| 2,700,520 | 1/1955 | Skubic | 108/53.5 |
| 2,700,521 | 1/1955 | Lapham | 108/52.1 |
| 3,249,071 | 5/1966 | Ansingh | 108/53.5 |
| 3,659,707 | 5/1972 | Nilsson et al. | 206/386 |
| 3,677,200 | 7/1972 | Coccagna et al. | 108/53.5 |
| 3,780,930 | 12/1973 | Starr | 206/386 X |
| 3,962,660 | 6/1976 | Duckett | 108/55.3 X |

FOREIGN PATENT DOCUMENTS

| | | | |
|---|---|---|---|
| 2404390 | 7/1975 | Fed. Rep. of Germany | 108/51.1 |
| 1049764 | 12/1953 | France | 108/51.1 |
| 1473103 | 2/1967 | France | 206/386 |

*Primary Examiner*—Roy D. Frazier
*Assistant Examiner*—William E. Lyddane
*Attorney, Agent, or Firm*—Thomas H. Olson

[57] ABSTRACT

A palletizing system for a plurality of generally parallelepiped cartons containing crushable products such as heads of lettuce. A pallet dimensioned to receive thereon a plurality of uniform size cartons in a rectangular pattern whereby orthogonal vertical confronting zones are formed intermediate the cartons. Two or more thin elongate compression resistant members and means for supporting the members on the pallet and within the zones. A rigid plate substantially congruent to the pallet for placement in bearing relation at the upper extremities of the compression resistant members so that the load from a plurality of cartons stacked on top of the plate will be transferred to the pallet and will not unduly compress or damage the cartons disposed below the plate.

4 Claims, 9 Drawing Figures

Fig-3
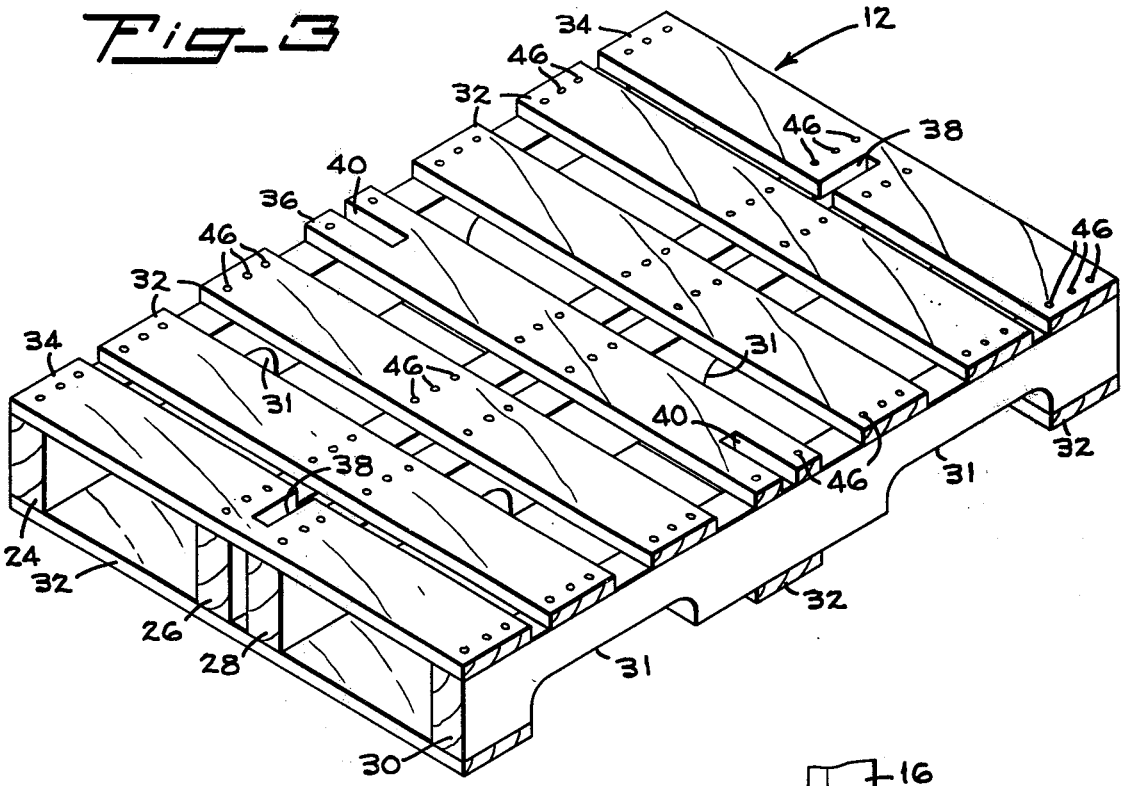
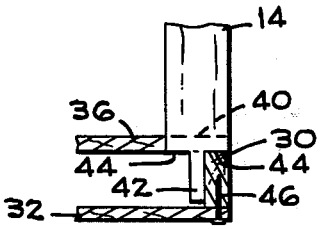
Fig-4
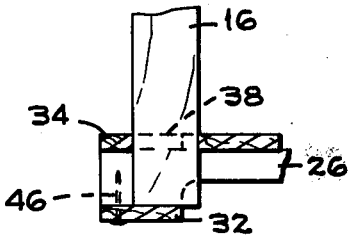
Fig-5
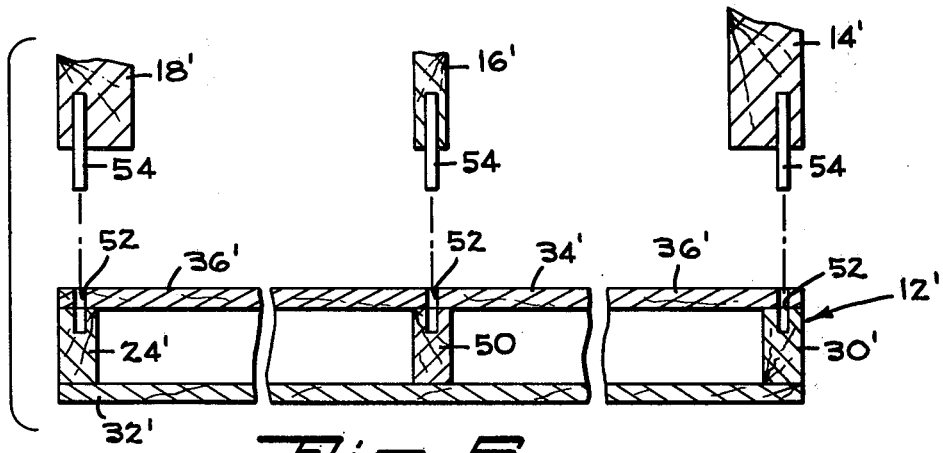
Fig-6

Fig-7
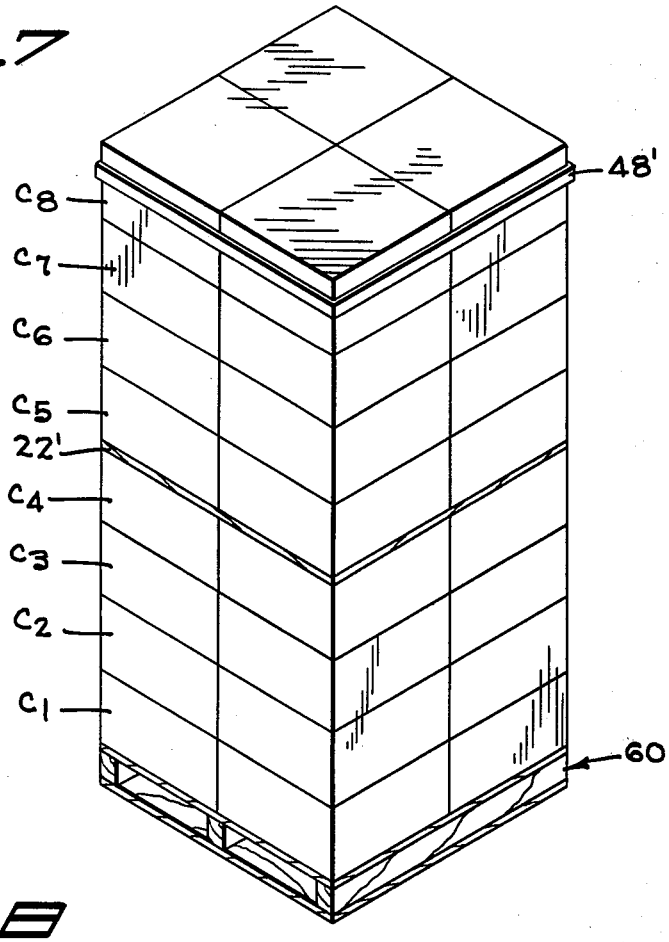
Fig-8
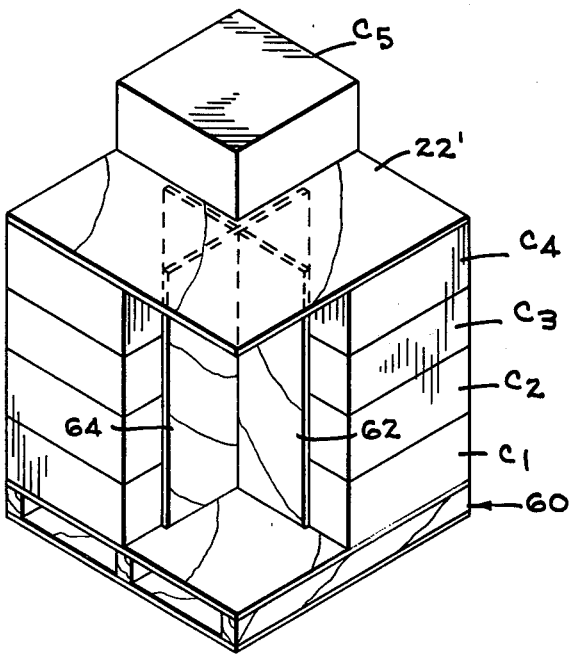
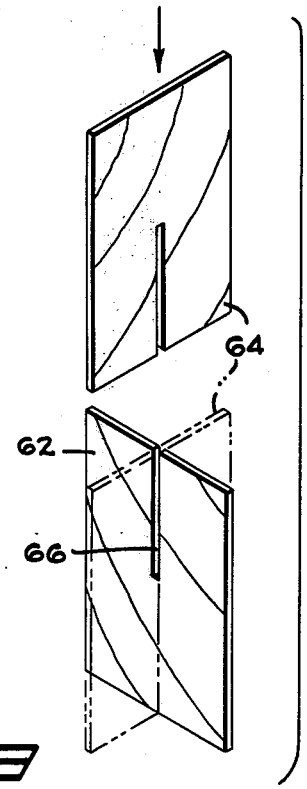
Fig-9

PALLETIZING SYSTEM FOR PRODUCE CARTONS AND THE LIKE

This is a continuation of application Ser. No. 708,335 filed July 26, 1976, now abandoned.

BACKGROUND OF THE INVENTION

1. Field of the Invention

This invention relates to a palletizing system and more particularly to such system for palletizing a plurality of cartons of relatively fragile material such that the weight of the upper cartons is not imposed on the lowermost cartons.

2. Description of the Prior Art

Advantages of the invention can be best appreciated in the context of prior art procedures employed in processing and shipping head lettuce. It has been the typical procedure for field hands to cut growing lettuce heads, remove the outer leaves from the heads, and place the heads in parallelepiped cartons which are sized to receive 24, 32, 40 or 52 heads of lettuce depending on the size of the heads and the size of the carton. Thereafter, the cartons are loosely stacked on a pallet for transport. In order to avoid crushing the heads on the lowermost tier of cartons, the stack on the pallet is typically limited to 4 or 5 tiers. The pallet loaded as described above is then transported to a vacuum cooler, loaded into the cooler for vacuum cooling and removed therefrom when cooling is completed. Thereafter, the cartons are removed from the pallet one-by-one and conveyed to a refrigerated vehicle, such as a semi-trailer or railroad car. The individual cartons are then loaded into the vehicle for shipment to their destination. In following the prior art procedure labor costs are substantial.

SUMMARY OF THE INVENTION

According to the present invention there is provided a palletizing system which permits the pallet to be loaded in the field and remain in the same loaded condition throughout processing, loading and shipment. By practicing the present invention, the labor costs are materially reduced.

It is, accordingly, an object of the invention to provide a palletizing system for crushable commodities which permits a large plurality of cartons of such commodities to be loaded onto a pallet without crushing those commodities residing the lowermost tiers of a stack of cartons of such commodities. This object is achieved by providing vertical load bearing members that extend upward from the pallet by a distance approximating one-half the total height of the loaded pallet so that most of the weight of the upper half of the total number of cartons is supported on such members and only a slight proportion of the weight is supported by the cartons at the bottom of the stack. As will appear in more detail hereinafter, one embodiment of the invention provides four elongate load bearing members and means for supporting them in upstanding relation to the pallet, and another embodiment provides two slotted sheets of rigid material which can be inter-engaged to define a decussate load bearing member having a vertical dimension equal to approximately one-half the total vertical height of the load to be placed on the pallet.

Another object of the invention is to provide a palletizing system capable of achieving the functions referred to above without unduly increasing the weight of the loaded pallet. This object is achieved according to the present invention by arranging the placement of the vertically extending load bearing members such that they reside in orthogonal vertical zones formed by confronting side faces of the cartons and therefore receive lateral support from the cartons so that relatively thin material can be employed for the load bearing members without risking failure under load due to buckling. That is to say, the members are highly resistant to buckling because they are laterally supported by the cartons disposed on the pallet.

A further object of the invention is to reduce loss of the commodities during shipment due to crushing or bruising. This object is achieved because a pallet according to the invention is arranged so that no tier of cartons or the commodities in the cartons bears the weight of the entire stack of cartons.

A feature and advantage of the invention is that the vertical load bearing members are confined solely within the perimeter of the pallet so as to avoid creation of protrusions from the relatively smooth side surfaces of the pallet.

The foregoing together with other objects, features and advantages will be more apparent after referring to the following specification and accompanying drawings.

BRIEF DESCRIPTION OF THE DRAWINGS

FIG. 3 is a perspective view of the pallet employed in the assembly of FIGS. 1 and 2.

FIG. 4 is a fragmentary cross-sectional view taken along line 4—4 of FIG. 2.

FIG. 5 is a fragmentary cross-sectional view taken along line 5—5 of FIG. 2.

FIG. 6 is a cross-sectional view showing an alternate structure for supporting the elongate members in place on the pallet.

FIG. 7 is a perspective view of a palletized assembly employing yet another alternate embodiment of the invention.

FIG. 8 is a perspective view of the assembly of FIG. 7 in an intermediate stage of assembly.

FIG. 9 is an exploded perspective view showing the compression resistant members employed in the assembly of FIG. 7.

DESCRIPTION OF THE PREFERRED EMBODIMENT

Figure 1:
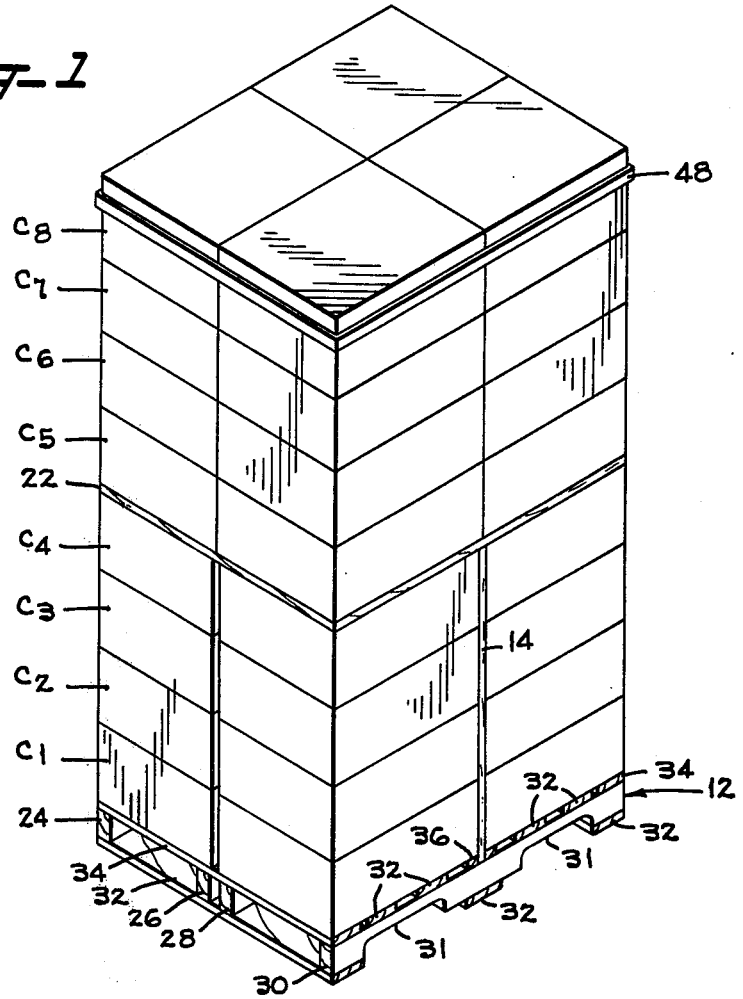
FIG. 1 is a perspective view of a palletized group of cartons according to one embodiment of the invention.

Referring more particularly to the drawing, reference numeral 12 indicates a four-sided rectangular pallet. From the mid point of each side of the pallet there are elongate compressive resistant members 14, 16, 18 and 20 which extend perpendicular to the pallet and upwardly therefrom. Supported in bearing relation on the respective upper extremities of elongate members 14–20 is a rigid plate 22 which is congruent to pallet 12. Plate 22 supports a plurality of cartons identified by the reference character C followed by a suitable subscript.

The subscripts for reference character C are cardinal numbers indicative of the height of the particular carton, in FIG. 1 $C_1$ indicating cartons in the lowermost tier and $C_8$ indicating cartons in the uppermost tier. Accordingly, the weight of cartons $C_5$ through $C_8$ are supported on pallet 12 through elongate members 14–20 and not by cartons $C_1$.

The detailed construction of pallet 12 is shown in FIG. 3. The pallet includes four substantially identical longitudinal members 24, 26, 28 and 30. The longitudinal members have a dimension corresponding to the length of the pallet which in turn corresponds to an integral multiple of the length of cartons C. The central pair of longitudinal members 26 and 28 are spaced from one another by a distance somewhat in excess of the thickness of members 16 and 20 so that the lower ends of such members can fit therebetween. For example, in one system designed according to the present invention lumber having a nominal dimension of 1"×4" (¾"×3½" net) was employed for compression members 16–20 and in such design the space between longitudinal members 26 and 28 is ⅞ of an inch. The longitudinal members are notched in their lower surfaces, as at 31, to accommodate a forklift truck.

Extending transversely of longitudinal members 24–30 are common stringers 32, identical end stringers 34 and a central stringer 36. In one system that has been designed according to the invention 1×6 boards (¾"×5½" net) are employed for the stringers 32, 34 and 36. End stringers 34 are centrally slotted at 38, the width of the slot corresponding to the space between longitudinal members 26 and 28 so as to admit elongate compression resistant members 16 and 20 therethrough. The length of slot 38 is such as to accommodate the vertical compression resistant members in their opposite dimension as shown in FIG. 5.

Central stringer 36 is formed at its opposite ends with identical notches 40, the notches having a width corresponding to the thickness of compression resistant members 14 and 18 and a length at least as large as the width of the compression resistant members. See FIG. 4.

The lower ends of compression resistant members 14 and 18 are formed to define a tennon 42 which resides on the inner surface of longitudinal members 24 and 30 so as to fix the compressive resistant members against outward movement. The longitudinal dimension of the tennon is less than the vertical dimension of longitudinal members 24 and 26 so that the weight carried by compression resistant members 14 and 18 is borne on the longitudinal members via an abutment surface 44. The tennon is formed symetrically of the center line of the compression resistant members in order to facilitate installation of the members into the pallet and in order to avoid creation of a large protrusion interior of the pallet which might interfere with engagement of the pallet by a forklift truck. Slots 38 and notches 40 are located such that when the compression resistant members 14–20 are engaged therein, the compression resistant members reside within vertically extending orthogonal zones defined between confronting side faces of cartons C.

All stringers 32, 34 and 36 are secured to the longitudinal members 24–30 with fasteners 46 that resist forces axially of the fasteners. For example, screws, nails with annular grooves or the like can be employed. The reason for employing fasteners of this type will be better appreciated in the following description of the operation of this embodiment of the invention.

Figure 2:
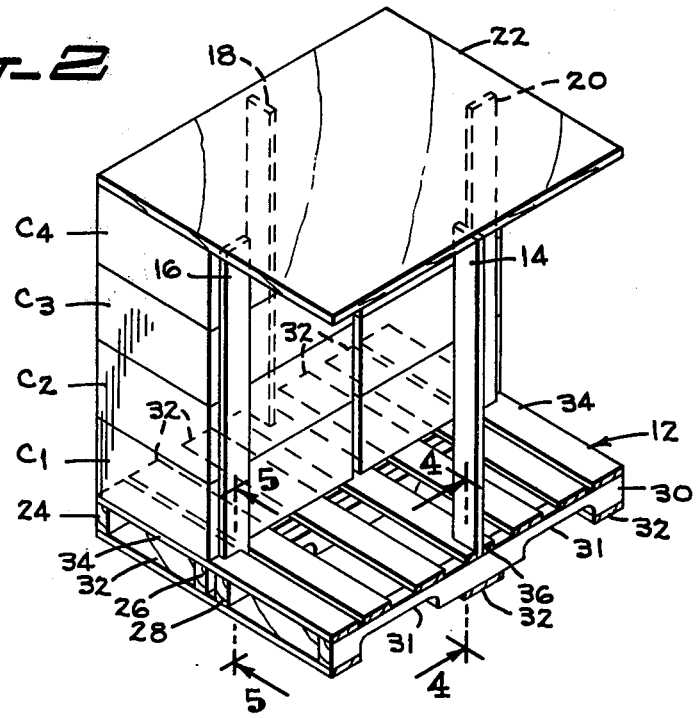
FIG. 2 is a perspective view of the palletizing system of FIG. 1 at an intermediate stage of assembly.

The operation of the palletizing system of the embodiment of FIGS. 1–5 will be described with particular reference to FIG. 2. In that Figure, the length of pallet 12 is twice the length of each carton C and the width of the pallet is equal to twice the width of each of the cartons. Accordingly, the zones formed by the confronting side faces of the cartons are coincident with the midpoints of the edge dimensions of the pallet. The length of compression resistant members 14–20 is established at a magnitude slightly less than the depth or height of four cartons. For example, in one system designed according to the invention cartons C have a depth or height of 11", and the length of compression resistant members 14–20 is established to dispose the upper bearing surfaces of the respective compression resistant members at a height 43½" above the upper surface of the pallet. A pallet 12 is placed on the field surface and compression resistant members 14–22 are installed as described above. Thereafter, cartons $C_1$ are placed on the pallet and arranged so that they bear on the side surfaces of the compression resistant members to retain them in vertical alignment. Thereafter, tiers composed of four cartons $C_2$, $C_3$ and $C_4$ are placed on the pallet after which plate 22 is introduced. Typically, palletizing glue is spread on the top panel of an in place carton before the carton in the next tier is placed thereon. There will be small clearance space between the upper extremity of the compression resistant members and the lower surface of plate 22 because of the dimensional relationship described above. Then the tiers composed of cartons $C_5$ through $C_8$ are placed on top of plate 22. This effects slight compression of cartons $C_1$–$C_4$ until further downward movement of plate 22 is inhibited when the plate contacts the upper bearing surfaces of compression resistant members 14–20 . Finally, a wrap of adhesive tape 48 is made around the periphery of cartons $C_8$ in the uppermost tier so as to retain the cartons in a firmly palletized form.

When the commodities contained in the carton C are heads of lettuce, the weight of a pallet loaded as shown in FIG. 1 is about 2,000 pounds. This weight is well within the limits of forklift trucks employed in agricultural environments so that the pallet can be lifted onto a truck or like transport vehicle. When the pallet is engaged from the end, i.e., from the side of the pallet adjacent end stringer 34, the upper four tiers of cartons $C_5$–$C_8$ bear on longitudinal members 24 and 30 and the lower common stringers 32. Because of the fact that the fasteners 46 are of special type as referred to above, and because the weight on the fasteners is only one-half of the entire load on the pallet, the integrity of the pallet is now adversely affected. Similar forces are imposed on the fasteners when the pallet is engaged by a forklift truck from the side, i.e., through notches 31 in the edge of the pallet adjacent longitudinal member 30.

The palletized cartons are then transported to vacuum cooling facilities and thence to transport vehicles such as railroad cars or semi-trailers, and finally to the warehouse or like distribution point at the final destination. Thus, once the cartons are palletized on the field they remain in the same configuration throughout their processing and transportation and until they are ready for distribution of restaurant, markets or like final users. Throughout the processing and transport of the palletized cartons, compression resistant members 14–20 are retained in a substantially straight vertical condition because they are disposed in the confronting zones formed by the side faces of the cartons. Thus, the above mentioned 1×4 lumber can be employed without significant danger of failure due to buckling because of this synergistic relationship between the cartons and the compression resistant members.

An alternate structure for fixing the lower ends of the elongate compression resistant members is shown in FIG. 6. Elements of the embodiment of FIG. 6 that correspond in function and/or construction bear identical reference characters which, however, are primed to afford unique identification of the elements. In FIG. 6, there is a pallet 12' formed by longitudinal members 24', 50 and 30'. Longitudinal member 50 is midway between members 24' and 30', that is, it lies along the centerline of the pallet. The longitudinal members are retained in assembled relationship by transverse common stringers 32', end stringers 34' and a central stringer 36'. At the midpoints of the respective edges of the pallet are bored holes 52, three of the holes being shown in FIG. 6. As shown, the center hole transpierces end stringer 34' and the end holes transpierce central stringer 36'. The holes partially enter the respective longitudinal members. In one system designed according to the invention, holes 52 have an overall depth of about 1½ inches. In the lower ends of the elongate compression resistant members, three such members being designated as 14', 16' and 18' in FIG. 6, are placed rods or dowels 54 that are sized to enter holes 52. Dowels 54 are preferably steel or the like, and in one system designed according to the invention are embodied in steel rod stock having a diameter of about 5/32nd inch; in such specific design, holes 52 have a diameter of 11/64ths inch so as to receive the dowels thereinto. Loading of the pallet and assembly of the parts incorporating the system as modified by FIG. 6 proceed as described above. That is to say, the four elongate compression resistant members are installed by engaging the dowels in the holes at the midpoints of the four sides of the pallet, the first four tiers of cartons are placed thereon, a plate 22 is placed on top of the four tiers of cartons, and an additional four tiers of cartons are placed on the plate as described above. The embodiment of FIG. 6 possesses certain advantages in fabrication and permits all four stringers to be identical. Otherwise, it is equivalent in operation and advantageous features to the embodiment described hereinabove in connection with FIGS. 1–5.

Another alternate form of the invention is shown in FIGS. 7–9. The embodiment there shown affords many of the salutary advantages described above and, in addition, does not necessitate the provision of a specially constructed pallet identified hereinabove by reference characters 12 and 12'. In the alternate embodiment, there is a more or less standard pallet 60 having dimensions as described hereinabove. Before cartons C are loaded onto the pallet a decussate supporting member composed of two substantially identical rigid sheets 62 and 64 is formed. As seen in FIGS. 8 and 9, the sheets have a horizontal dimension less than the length or width of pallet 60 so that sheets 62 and 64 reside with the orthogonal vertical zones formed between the confronting side faces of the cartons. The sheets have a height corresponding to the length of compression resistant members 14–20 described above. Centrally of sheet 62 is a vertical slot 66 which has a width equal to or greater than the thickness of sheet 64 and a length equal to approximately one-half the vertical dimension of the sheet. Sheet 64 has an identical slot. In one system designed according to the embodiment of FIGS. 7–9, sheets 62 and 64 are fabricated of ½" particle board having a vertical dimension of about forth inches. In such exemplary sheet the length of slot 66 is 20½" and the width of the slot is ¾". Two such sheets can be assembled in decussate form to support a rigid plate 22' above the surface of the pallet, and therefore avoid imposition of excessive weight on carton $C_1$ in the lower tier of cartons on the pallet. After four tiers of cartons are placed on pallet 60, it can be seen that they give substantial lateral support to plates 62 and 64 which, in combination with the interengagement of the slots 66 of the sheets, rigidly supports plate 22'. Thereafter, four additional tiers of cartons $C_5$–$C_8$ are placed on the plate and the palleted load is completed with tape 48' as described above. Further processing and handling of the pallet of FIGS. 7–9 is identical to that described above.

In the embodiments of the invention described hereinabove each tier of cartons contains four cartons. Such number is exemplary and not limiting. One design based on the invention is arranged so that each tier contains six cartons. In such design there are six elongate compression resistant members, and pairs of the elongate members and elements for fixing their respective lower ends are provided at equally spaced intervals along two opposite edges of the pallet. Thus, the elongate compression resistant members reside in the zones between adjacent cartons and thus receive lateral support from the cartons as in the embodiments described in detail hereinabove.

Thus, it will be seen that the palletizing system of the invention provides a system which affords vast improvement in efficiencies of handling commodities such as head lettuce from the field to the place of final consumption. Handling costs are materially reduced because the invention provides a system wherein the individual cartons are firmly supported on the pallet. Moreover, products in the lowermost cartons are not adversely affected by the weight of those superposed thereon because the weight of the upper half of the pallet is distributed to the pallet itself and not to the lowermost cartons.

Although in the foregoing description and the appended claims the cartons are referred to as parallelepiped cartons, it is to be understood that in practice the cartons when packed bulge somewhat at the side panels. Such bulged cartons are substantially parallelepiped and are comprehended within the term parallelepiped. Moreover, the zones between such bulged cartons provide space for the compression resistant members at locations near to but spaced from the bulges.

The invention can be incorporated into existing material handling systems with very little or no modification to the systems. Because of the fact that in all embodiments of the invention the vertical compression resistant members receive lateral support from the cartons employed, the compression resistant members can be made of relatively thin material which is both inexpensive and light in weight. Although several embodiments of the invention have been shown and described, it will be obvious that other adaptations and modifications can be made without deparing from the true spirit and scope of the invention.

What is claimed is:

1. A palletizing system for a plurality of parallelepiped cartons each having a length, width, and height, said palletizing system comprising a plurality of said cartons, a rectangular pallet having length and width dimensions substantially equal to integral multiples of the respective length and width dimensions of the cartons, said cartons being placed on the pallet in four equal tiers to form orthogonal vertical zones therebetween, at least four independent thin elongate compression resistant members of rectangular cross section, said elongate members having a thickness dimension and a width dimension substantially greater than said thickness dimension, means for supporting said elongate compression resistant members in upstanding relation of said pallet in vertical planes within said zones and adjacent to respective sides of said pallet so that the width dimension is perpendicular to the respective side, said supporting means including portions of said pallet defining upward opened sockets and said elongate compression members having lower portions configured for entry into said sockets, said elongate compression resistant members having a length approximately equal to an integral multiple of the height of the cartons, and a rigid planar plate substantially congruent to said pallet for placement in bearing upon the upper extremities of said elongate compression resistant members so as to be supported in parallel spaced relation above said pallet and to transfer the load of cartons disposed thereon to said pallet through said elongate compression resistant members.

2. A palletizing system according to claim 1 wherein each said socket comprises a portion of said pallet in the margin adjacent the edge thereof defining an upward open slot, said slot being sized to receive thereinto one end of said elongate members.

3. A palletizing system according to claim 1 wherein each said socket includes an upward open cylindric hole in said pallet in the margin adjacent the edge thereof, said lower end of said elongate member having a dowel extending therefrom, said dowel and said cylindric hole being dimensioned so that said dowel is receivable in said cylindric hole.

4. A method for palletizing a plurality of parallelepiped cartons each having a length, width and height comprising the steps of providing a rectangular pallet having length and width dimensions substantially equal to an integral multiple of the respective length and width dimensions of the cartons, placing a plurality of cartons on the pallet in uniform tiers so that confronting side surfaces of the cartons form orthogonal vertically extending zones between individual cartons in said tiers, forming four upward opened sockets in the pallet adjacent to respective sides of the pallet and in alignment with said zones, providing four individual thin elongate compression resistant members of rectangular cross section having a vertical dimension approximately equal to an integral multiple of the height of said cartons, a thickness dimension equal to width of the zone, a width dimension substantially greater than the thickness dimension, and lower end portions configured for entry into the sockets, introducing the lower end portions of the compressions resistant members into the sockets in the pallet so that the thickness dimension extends between the confronting side carton surfaces that form the zones thereby to support the elongate members against buckling, providing a rigid planar plate congruent to the pallet, placing the plate on the upper extremities of the compression resistant members, and placing additional cartons on said plate.

* * * * *